United States Patent [19]
Brenner et al.
[11] 4,186,573
[45] Feb. 5, 1980

[54] RINSE OUT CENTRIFUGALLY OPERATED DISPENSER FOR AUTOMATIC WASHER

[75] Inventors: Robert A. Brenner, St. Joseph Township, Berrien County; Victor W. Cuthbert, Sodus Township, Berrien County, both of Mich.

[73] Assignee: Whirlpool Corporation, Benton Harbor, Mich.

[21] Appl. No.: 13,009

[22] Filed: Feb. 21, 1979

[51] Int. Cl.[2] ..... D06F 39/02
[52] U.S. Cl. ..... 68/12 R; 68/17 R; 68/207
[58] Field of Search ..... 68/17 R, 207, 12 R; 222/168

[56] References Cited

U.S. PATENT DOCUMENTS

| | | | |
|---|---|---|---|
| 2,792,701 | 5/1957 | Bochan | 68/17 A |
| 2,912,842 | 11/1959 | Tingley, Jr. | 68/17 R X |
| 2,915,890 | 12/1959 | McEwen | 68/148 |
| 2,942,444 | 6/1960 | Abresch | 68/17 A |
| 2,967,416 | 1/1961 | Devery | 68/17 A |
| 3,085,418 | 4/1963 | Douglas | 68/17 A |
| 3,095,722 | 7/1963 | Fox | 68/207 |
| 3,107,512 | 10/1963 | Cobb | 68/17 R |
| 3,248,914 | 5/1966 | Tingley, Jr. | 68/207 |
| 3,268,120 | 8/1966 | Durst | 222/168 |
| 3,520,156 | 7/1970 | Douglas | 68/17 A |

*Primary Examiner*—Philip R. Coe
*Attorney, Agent, or Firm*—Hill, Van Santen, Steadman, Chiara & Simpson

[57] ABSTRACT

A rinse or detergent additive dispenser for use in a laundry appliance hangs inside a spin basket and has a first compartment to hold and retain additive during a wash portion of a cycle, and a second compartment communicating with the first compartment which is filled by centrifugal force imparted to the additive in the first compartment during a spin portion of a wash cycle. An opening in the bottom of the second compartment allows gravitational draining of the additive therein when the centrifugal force is removed when rotation of the spin basket ceases, allowing the additive to be dispensed. The first compartment and the automaic washer water inlet are constructed and disposed in registry so that as the dispenser passes under the water inlet during the spray rinse spin of the cycle, the dispenser is rinsed clean.

8 Claims, 5 Drawing Figures

FIG. 3
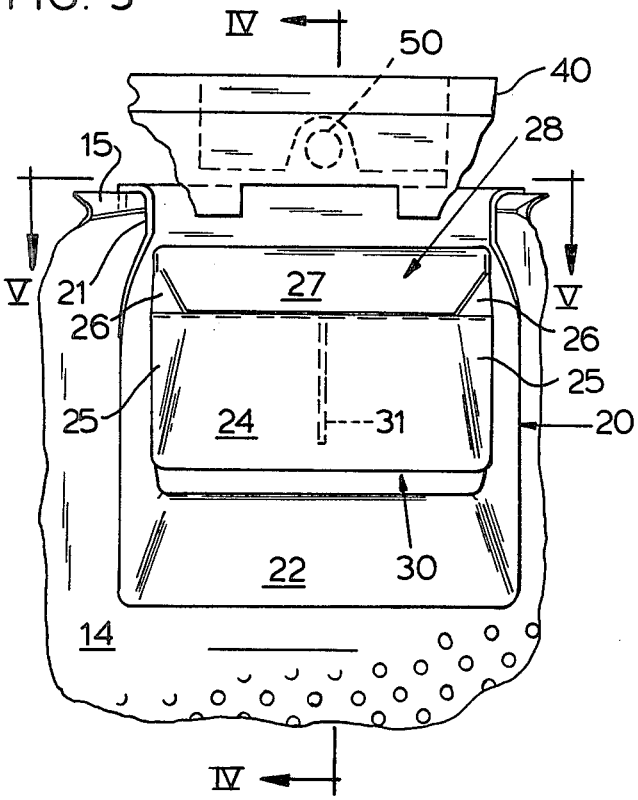
FIG. 4
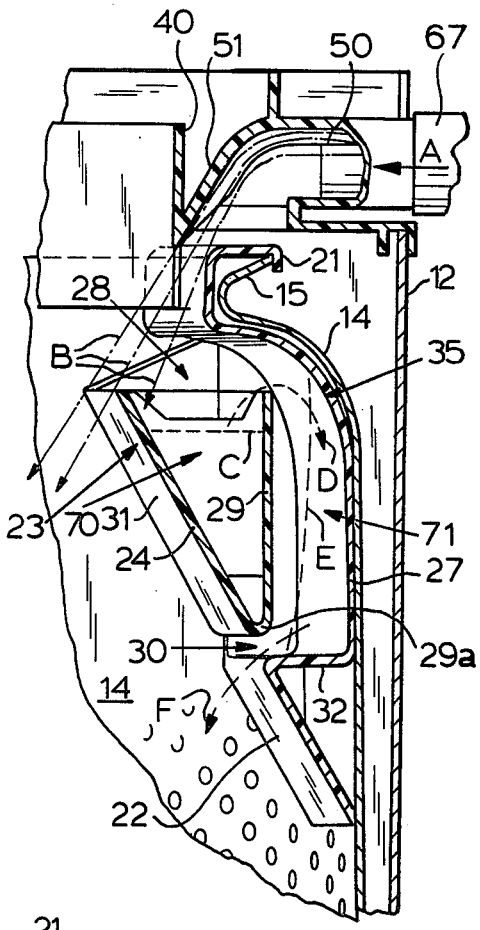
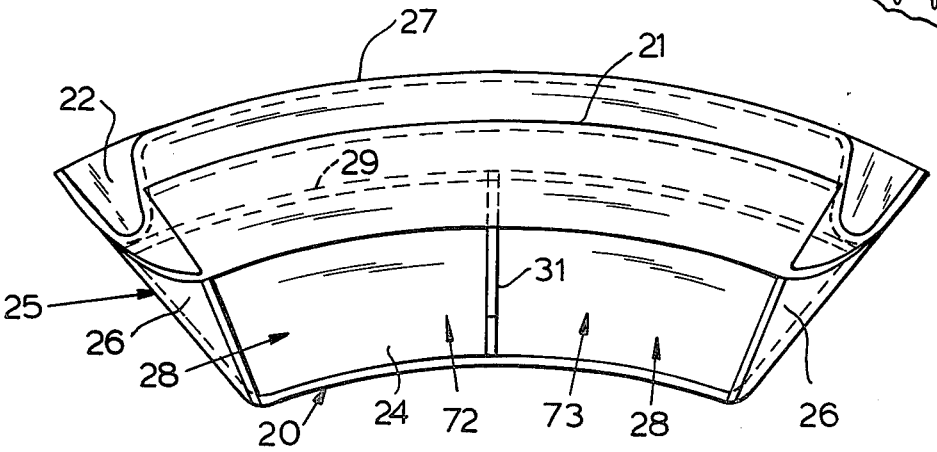
FIG. 5

RINSE OUT CENTRIFUGALLY OPERATED DISPENSER FOR AUTOMATIC WASHER

BACKGROUND OF THE INVENTION

1. Field of the Invention

This invention is in the field of detergent additive dispensers for use with a laundry appliance having a rotating spin basket.

2. Description of the Prior Art laundry appliances already known in the art are usually mounted at various positions allowing communication with the washing liquid at some point during the course of the wash cycle. Such dispensing devices are frequently mounted either on or in connection with the central agitator post, or along the rim of the basket holding the items to be wash.

Spin basket mountable dispensing devices such as shown in U.S. Pat. No. 3,268,120 rely on the centrifugal force generated by the rotation of the spin basket to transfer the liquid to be dispensed from a first compartment to a second compartment, said liquid then being gravitationally dispensed upon cessation of rotation. Such dispensers, however, are not constructed to accept inlet water from an inlet water source communicating with the interior of the spin basket. The nature of most liquids used in connection with laundry appliances is such that use over a period of time results in deposits of dried, unused liquid accumulating at various places in the devices. Such build-up generally occurs at portions of the device where the flow of liquid is somewhat constricted. If such deposits are not frequently removed by rinsing, accumulation of dried liquid may be such as to completely block the flow channel, resulting in complete failure of the device.

None of the liquid dispensing devices known in the art are constructed to receive water from the water inlet source of the laundry appliance during a post-dispense step of a wash cycle so that the device is rinsed as a part of every complete wash cycle, thereby preventing the build-up of deposits and obviating the deficiencies of the liquid dispensing devices known in the art which must be removed from the laundry appliance and rinsed manually at periodic intervals to prevent such build-up.

SUMMARY OF THE INVENTION

The present invention provides a laundry liquid dispenser which is attachable to the upper rim of a rotating spin basket in an automatic laundry appliance. In the preferred form of the present invention, the dispenser has a first compartment with an opening for filling which extends into the spin basket. Liquid poured into the first compartment will remain therein while the spin basket and dispenser are at rest, such as during the wash cycle of the laundry appliance. During a portion of the wash cycle the spin basket is rapidly rotated to remove water from the items to be washed. Such rotation imparts a centrifugal force which causes the liquid in the first compartment to flow into a second compartment in the dispenser communicating with the first compartment. The liquid is maintained in the second compartment as long as the spin basket is rotating, and flows gravitationally therefrom through an opening in the bottom of the second compartment when rotation ceases.

The filling opening of the first compartment extends a sufficient distance into the spin basket to receive inlet water from the water inlet source communicating with the wash basket of the laundry appliance. After the liquid to be dispensed has flowed into the wash basket, the subsequent activation of inlet water during the rinsing steps of the cycle washes out the dispenser so as to prevent build-up of incompletely dispensed, dried additive.

The first compartment of the dispenser is divided by a partition into two communicating portions, so that movement of the liquid is restricted and spillage from the portions will not occur should the basket move during the agitation portion of the cycle. The dispenser may be used to dispense detergent or rinse additive. Detergent, but not rinse additive, may be dispensed where the wash cycle consists of a rinse, spin, wash, spray rinse spin, spin, rinse and spray rinse spin because the detergent will thus be added to the wash portion of the cycle. Rinse additive may be dispensed where the wash cycle consists of wash, spin, rinse and spray rinse spin because the rinse additive will be added to the rinse portion of the cycle.

BRIEF DESCRIPTION OF THE DRAWINGS

FIG. 3 is an enlarged frontal view of the liquid additive dispenser mounted in the spin basket of a laundry appliance.

FIG. 4 is a sectional view taken along the line IV—IV of FIG. 3.

FIG. 5 is an elevational plan view of the liquid dispensing device taken along line V-V of FIG. 3.

DESCRIPTION OF THE PREFERRED EMBODIMENTS

Figure 1:
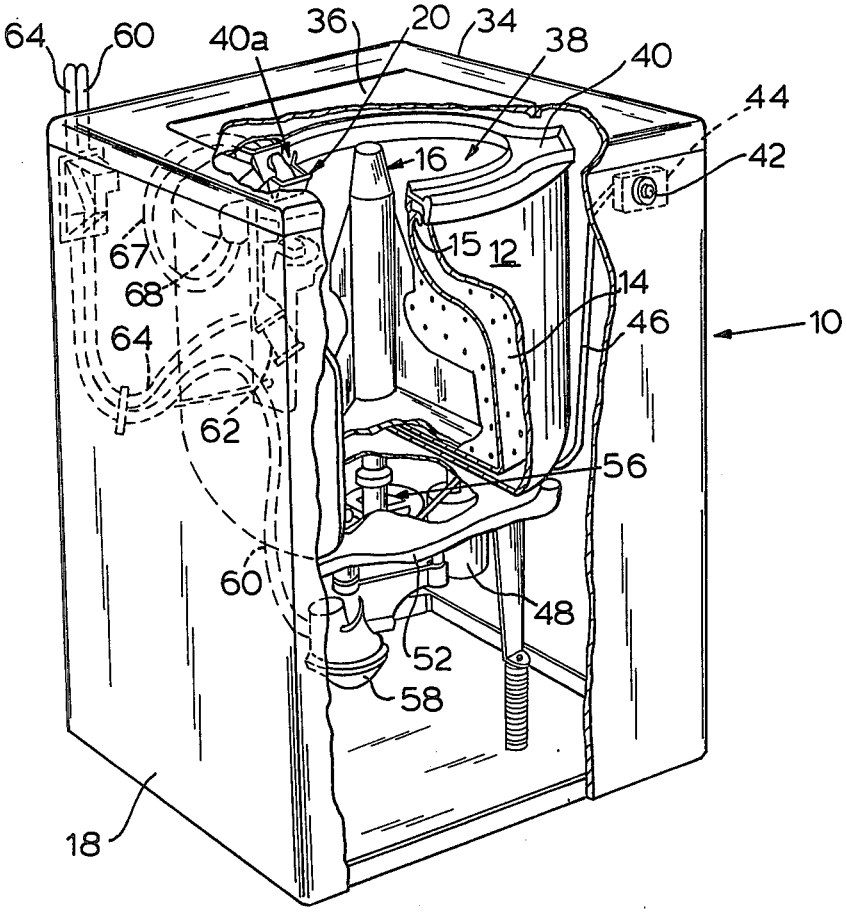
FIG. 1 is a perspective view, partly broken away, of a conventional type of automatic washing machine which is provided with the rinsable liquid additive dispenser of the present invention.

An automatic washing machine is generally illustrated in FIG. 1 at 10 as comprising a tub 12 which has a perforate clothes container or spin basket 14 contained in the tub 12 and an agitator 16 vertically disposed within the spin basket 14 and mounted for oscillatory movement with respect thereto and for spinning movement with the basket during centrifugal extraction of water from the clothes within the basket 14. The tub 12, the spin basket 14, the agitator 16 and a drive mechanism 56 therefor are contained in a cabinet 18.

The cabinet 18 also has a top 34 having a hinged lid 36 which is opened to afford access to a clothes receiving opening 38 defined by a tub ring 40 extending about the tub and over a corresponding opening in the spin basket 14. The cabinet 18 also includes a pre-selectable sequential control means having a timer dial 42 connected to a timer-controller 44 which is mounted at the front of the cabinet 18. Suitable wiring 46 connects the timer 44 to a drive motor 48 and to other electrical components of the machine to control operation of the washing machine through a programmed sequence of a wash cycle. The wash cycle may include a wash portion, wherein a clothes load is agitated in a water and detergent solution, a spin portion where the basket 14 is rotated at high speed to centrifugally extract the wash solution from the load, a rinse portion wherein the load is agitated in a water solution with or without a rinse additive, and a spray rinse spin portion wherein the basket is rotated to centrifugally extract the water from the load while inlet water is sprayed on the load to further rinse the load. Other sequences are of course possible and may be used as hereinafter described. The timer dial 42 and the timer 44 may be mounted in any desired location and are shown in their present location for illustrative purposes only.

A pump 58 is provided for removing wash or rinse water from the tub 12 at the termination of a washing or rinsing operation and is suspended from a base plate 52. The pump is connected to drain the tub 12 through a drain hose 60. The motor 48, the drive mechanism 56 and the pump 58 may be mounted in any convenient manner inside the cabinet 18 and need not necessarily occupy the positions shown in FIG. 1.

The cabinet 18 also forms a mounting for a suitable water inlet valve 62 of conventional construction which controls the supply of water introduced into the tub 12 for a particular selected washing or rinsing operation. The water inlet valve provides selective fluid communication between an inlet hose 64 connected to a source of water under pressure and a conventional anti-siphoning device 68 which may be mounted on the tub ring 40.

As shown in FIGS. 1, 3 and 4 a rinsable laundry additive dispensing device 20 is shown hanging from a flange 15 at the top of the spin basket 14. The dispenser 20 is shown disposed beneath a portion 40a of the tub ring 40 which includes a water inlet opening 50 connected to a hose 67 extending from anti-siphon device 68.

Figure 2:
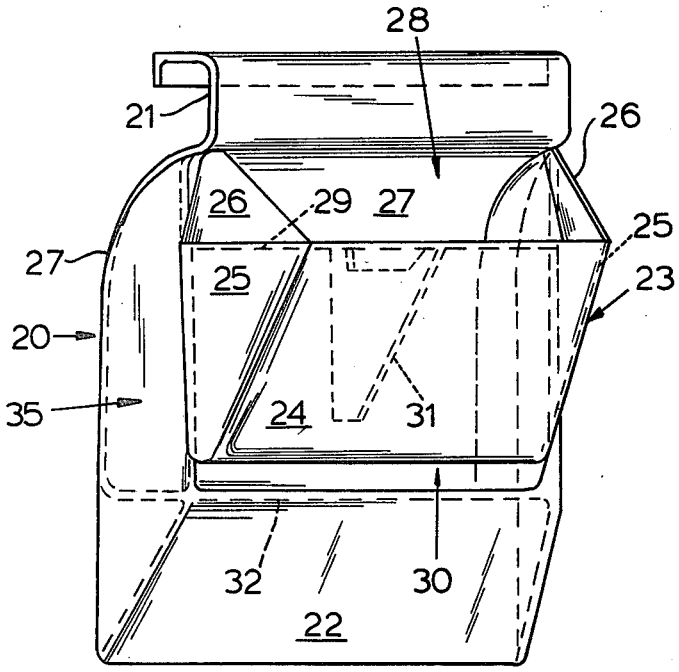
FIG. 2 is a perspective view of the rinsable liquid additive dispenser.

The laundry additive dispenser is shown in an enlarged perspective view in FIG. 2. As best shown in FIG. 4, the dispenser 20 has a hanger 21 which snaps over the flange 15 on the spin basket 14 to provide sufficient friction between the flange and the hanger to hold the dispenser 20 substantially immovable with respect to the spin basket 14 during machine operation. Note, however, that the dispenser is manually movable circumferentially on the flange 15. This is accomplished by grasping the dispenser 20 and sliding it circumferentially on flange 15 of basket 14. The dispenser can thus be manually moved to any desired location for filling with a liquid additive and to insure that the dispenser is not positioned under inlet opening 50 after filling. The dispenser 20 has a back wall 27 which rests adjacent the perforated spin basket 14. An inclined lower portion 22 also rests against the spin basket 14 to provide further stability. A first compartment 23 is comprised of a front wall 24 which is upwardly inclined toward the interior of the spin basket 14 in which the dispenser 20 is mounted. A rear wall 29 is attached to the bottom of the front wall 24 at lower portion 29a with triangular side panels 25 attached between the back portion 29 and the front wall 24 to provide a fluid-holding compartment 23. The compartment is divided into two communicating portions shown in FIG. 5 as 72 and 73 by a dividing wall 31. The dividing wall 31 reduces the possibility of spillage caused by any movement of the basket during the agitate portion of the cycle because it acts as a baffle to reduce liquid flow across the compartment 23. Two triangular portions 26 are attached at the top of each of the side walls 25 to define a filling opening 28 in conjunction with the back wall 27 and the top of the front wall 24.

A second compartment 35 is defined by the back wall 27 and the rear wall 29 of the first compartment 23. A base 32 and lower portion **29*a* of the first compartment 23 define an opening 30 at the bottom of the second compartment 35**.

As shown in FIG. 5, the entire dispenser 20 possesses a curved shape so as to rest adjacent the spin basket 14. The side wall 25 and the partition panel 31 may lie on radii of the spin basket 14, or the side walls 25 may be slanted inwardly at a more acute angle.

The liquid dispensing device 20 is shown positioned in FIGS. 3 and 4 in intercepting registry beneath water inlet port 50 of the laundry appliance 10. An interior portion 51 of the tub ring 40 is flanged downwardly from the inlet port 50. As shown in FIG. 4, water emerging from the inlet port 50 in thereby dispersed in a diverging spray by the outlet defined by the flange 51.

Operation of the liquid dispensing device 20 during a wash cycle of the laundry appliance 10 is demonstrated in FIG. 4. Liquid 70 to be dispensed is poured into the first compartment 23 of the device 20 via the opening 28 to a level represented at C. During the wash portion of the wash cycle, the spin basket and liquid dispensing device 20 mounted thereon remain relatively stationary with respect to the tub 12, and the liquid 70 in the first compartment 23 is therefore undisturbed. After the wash portion of the cycle, the spin basket 14 is rapidly rotated to extract water from the items being washed, and the centrifugal force generated by the rotation moves the liquid 70 from the level C in the direction of arrow D. When maximum angular velocity is attained, the liquid 70 will be held in a position 71 against the curved back wall 27 of the dispenser 20, generally defined by a line E. When the centrifugal force is removed when the rotation ceases at the end of the spin portion of the cycle, the liquid 70 will gravitationally flow through the opening 30 at the bottom of the second compartment 35 in the direction of arrow F and be dispensed into the interior of the basket 14.

After the liquid 70 has flowed from the dispensing device 20 and an agitation period has been completed, a spray rinse spin portion of the wash cycle is initiated. During this portion of the cycle, the spin basket will again rotate and once each revolution the opening 28 will pass beneath the area **40*a* of the tub ring 40 wherein the inlet port 50 is disposed. Rinse water will emerge from the inlet port 50 toward the interior of the basket 14 in the direction of arrows B. The first compartment 23 of the dispensing device 20 extends a sufficient distance into the basket 14 such that a portion of the inlet water will be captured in the compartment 23. The rinse water will pass through the dispenser 20 in the same manner as the laundry additive by being centrifugally forced into the second compartment 35 due to the spinning of basket 14 and will gravitationally flow through the opening 30 when rotation of basket ceases. The dispenser 20 is thereby rinsed clean after each use, preventing build-up of deposits of incompletely dispensed laundry additive which may remain in the dispenser 20**.

It may be desirable to utilize the dispenser 20 with different types of laundry additives. The liquid in the liquid dispensing device 20 will be dispensed in the first spin portion and that should be prior to a spray rinse cycle to rinse out the device 20. Thus, detergent, but not rinse additive may be dispensed where the wash cycle consists of portions such as rinse, spin, wash, spray rinse spin, spin, rinse and spray rinse in that order. The detergent is dispensed after the first spin for use in the wash portion and the dispenser cleaned during the later spray rinses. A rinse additive may be dispensed where the cycle is wash, spin, rinse, and spray rinse spin in that order because the rinse additive will be dispensed into the rinse water and the dispenser washed out by the spray rinse spin.

Various modifications and changes may be apparent to those skilled in the art without departure from the spirit and scope of the present invention, and applicants intend to include within the patent warranted hereon all such changes and modifications as may reasonably and properly be included within the scope of our contribution to the art.

The embodiments of the invention in which an exclusive property or privilege is claimed are defined as follows:

1. For use in an automatic laundry appliance having a circular rotatable spin basket containing items to be washed, an inlet means disposed above an upper rim of said basket for supplying wash liquid, and means for controlling a cycle of operation including an agitation portion, a spin portion, and a spray rinse portion, the improvement of a rinsable liquid additive dispenser for said laundry appliance comprising:

a first selectively fillable receptacle for containing said additive during said agitation portion of said cycle, said first receptacle having an inlet for receiving said additive and for receiving a supply of liquid from said appliance inlet means during said spray rinse portion to clean said dispenser; and a second receptacle communicating with said first receptacle for receiving said additive from said first receptacle during said spin portion, said second receptacle containing said additive received during said spin portion, said second receptacle having an outlet for discharging said received additive at the end of said spin portion of the cycle; and a mounting means for mounting said additive dispenser on said upper rim of said basket.

2. The rinsable liquid additive dispenser of claim 1 wherein said first receptacle is comprised of:

an upwardly inclined front wall;

a vertical rear wall having a bottom edge attached to a bottom edge of said front wall;

two triangular side walls disposed between said front wall and said rear wall; and wherein said inlet extends the entire length of said first receptacle and is defined by upper edges of said front wall, said rear wall, and said side walls.

3. The rinsable liquid additive dispenser of claim 1 wherein said first receptacle is divided into two communicating compartments by a vertical partition disposed between and attached to said front wall and said rear wall midway between said side walls to reduce liquid movement within said first receptacle.

4. The rinsable liquid additive dispenser of claim 3 wherein said side walls and said vertical divider are co-linear with radii of said spin basket.

5. The combination of:

a laundry appliance having a pre-settable sequential control means to control a selectivey entered program of periods in a cycle for washing clothes contained in a rotatable basket in said appliance;

a nozzle mounted above said basket for discharging a flow of pressurized water into said basket; and a liquid additive dispenser mounted on an upper rim of said basket for co-rotation therewith such that during each revolution of said basket during a spray rinse period of said cycle said dispenser is passed beneath said nozzle and receives an input of pressurized water thereby rinsing said dispenser clean.

6. The combination of:

a laundry appliance having a pre-settable sequential control means to control a selectively entered program of an agitate portion, a spin portion, and a spray rinse portion of a wash cycle;

a rotatable basket for containing clothes to be washed vertically disposed in said appliance having a circular upper rim;

a nozzle mounted above said rim of said basket for discharging a pressurized flow of water into said basket; and a liquid laundry additive dispenser mounted on said basket rim for co-rotation with said basket, said dispenser cooperating with said nozzle to receive said pressurized flow by repeatedly passing beneath said nozzle during said spray rinse portion of said cycle thereby rinsing said dispenser clean of laundry additive after each use.

7. The combination of claim 6 wherein said dispenser includes a first receptacle having an inlet for receiving said additive and pressurized flow and a second receptacle communicating with said first receptacle for receiving said additive from said first receptacle during said spin portion and said flow of water during said spray rinse portion.

8. The combination of claim 7 wherein said additive dispenser is manually movable relative to said rim to facilitate receiving said liquid additive through said inlet.

* * * * *